US007534329B2

(12) United States Patent
Van Gent

(10) Patent No.: US 7,534,329 B2
(45) Date of Patent: May 19, 2009

(54) FRAME FOR HOLDING SHEET MATERIAL TAUT

(75) Inventor: Pieter Maarten Van Gent, Gouda (NL)

(73) Assignee: Stork Fokker AESP B.V., Papendrecht (NL)

( * ) Notice: Subject to any disclaimer, the term of this patent is extended or adjusted under 35 U.S.C. 154(b) by 830 days.

(21) Appl. No.: 10/627,625

(22) Filed: Jul. 28, 2003

(65) Prior Publication Data

US 2004/0075087 A1 Apr. 22, 2004

(30) Foreign Application Priority Data

Jul. 26, 2002 (NL) ..... 1021165

(51) Int. Cl.
*C25D 17/08* (2006.01)

(52) U.S. Cl. ..... 204/297.09; 204/297.06; 204/297.07; 204/297.1; 204/297.14; 72/295; 72/296; 72/302; 72/305; 72/422; 118/33

(58) Field of Classification Search ..... 204/297.1, 204/297.14, 297.06, 297.07, 297.09; 72/295, 72/296, 302, 305, 422; 118/33
See application file for complete search history.

(56) References Cited

U.S. PATENT DOCUMENTS 3,826,483 A * 7/1974 Siegel ..... 269/203
5,937,751 A * 8/1999 Newman, Jr. ..... 101/127.1
2002/0088846 A1* 7/2002 Bolde ..... 228/264

OTHER PUBLICATIONS

Patent Abstracts of Japan, 02115398, Apr. 27, 1990, Ibiden Co. Ltd.
Patent Abstracts of Japan, 62222081, Sep. 30, 1987, Toyo Giken Kogyo KK.
Database WPI, Section PQ, Week 199436 Derwent Publications Ltd., Lond, GB, AN 1994-289079 XP002237408.

* cited by examiner

*Primary Examiner*—Bruce F Bell
(74) *Attorney, Agent, or Firm*—Young & Thompson

(57) ABSTRACT

A frame for holding sheet material taut comprises a support as well as two legs which extend essentially parallel to one another transversely from the support, on which legs fixing elements are provided for fixing, in each case, one of the opposing edges of a piece of sheet material thereto. At least one of the legs can be moved along the support towards and away from the other leg. Furthermore compensation elements are provided for compensating for stretch and/or shrinkage of the piece of sheet material fixed between the legs.

16 Claims, 2 Drawing Sheets

FRAME FOR HOLDING SHEET MATERIAL TAUT

BACKGROUND OF THE INVENTION

The invention relates to a frame for holding sheet material taut.

DESCRIPTION OF THE RELATED ART

Such a frame can be used, for example, in the electrolytic treatment of the surface of metal sheets. For this purpose the frame with the taut sheet is placed in a bath containing an electrolytic liquid. The pre-treatment of aluminum sheets are processed to give laminated skin panels for the aviation and aerospace industry may be mentioned by way of example. Such aluminum sheets are anodised in a chromic acid bath.

Usually the sheets are fairly thin, between 0.3 mm and 0.4 mm, as a result of which they are fairly vulnerable to damage such as creases, scratches and the like. For this reason as well the use of a frame is necessary.

The fame with the sheet is placed vertically in the bath. To prevent the relatively thin sheet sagging during this operation it must be held taut in the frame. The tensile pretension resulting from pretensioning must be maintained throughout the entire electrolysis process. However, this cannot always be guaranteed, especially in the case of relatively large sheets. As a consequence of the electrolysis the is a rise in temperature, as a result of which the sheet expands. The tensile pretension decreases as a result and can even be completely lost. The sheet will consequently start to sag, which can lead to damage and creasing.

SUMMARY OF THE INVENTION

The aim of the invention is to provide a frame with which this problem does not arise. According to a first aspect of the invention this aim is achieved in a frame for holding sheet material taut, comprising a support as well as two legs which extend essentially parallel to one another transversely from the support, on which legs fixing means are provided for fixing, each one of the opposing edges of a piece of sheet material thereto, characterised in that at least one of the legs can be moved along the support towards and away from the other leg. According to a preferred embodiment compensation means are provided which interact with a movable leg to compensate for stretch and/or shrinkage of the piece of sheet material bled between the legs.

When the taut sheet becomes warmer during the treatment the tensile pretension therein can nevertheless be maintained by the action of the compensation means. These can be constructed in various ways. Preferably, the compensation means comprise a spring member, one end of which is able to bear on a fixed point in the fame and the other end of which interacts with the movable leg. Other embodiments are, however, also possible, such as, for example, with motorised means for holding taut that are controlled by a tension sensor.

The compensation means can comprise a securing member that can be secured in various positions along the support, the sprig member extending between said securing member and the movable leg. The support can comprise an I-shaped or upside-down T-shaped beam, in which case the securing member comprises a movable clamp around the bottom flange of the support. Preferably, the clamp has a slider with respect to which the movable leg can be slid, which slider has a stop to limit the sliding movement of the leg with respect to the clamp.

According to a simple embodiment, the spring member has a helical spring as well as a guide extending through the helical spring, which guide is attached at one end to the clamp such that it can slide and at the opposing end is fixed to the leg. This guide can have a stop that interacts with the clamp, such that the helical spring is pretensioned between the clamp and the leg if the stop is in contact with the clamp.

The movable leg has a base provided with rollers that can be rolled relative to the beam. In the conventional manner, the legs have contact means for feeding an electric current through sheet metal material.

Finally, he invention relates to a device for carrying out an electrochemical treatment on sheet metal, comprising a container for a liquid bath as well as a frame as described above.

BRIEF DESCRIPTION OF THE DRAWINGS

The invention will be further described with reference to an illustrative embodiment of a frame according to the invention shown in the figures.

DESCRIPTION OF THE PREFERRED EMBODIMENTS

Figure 1:
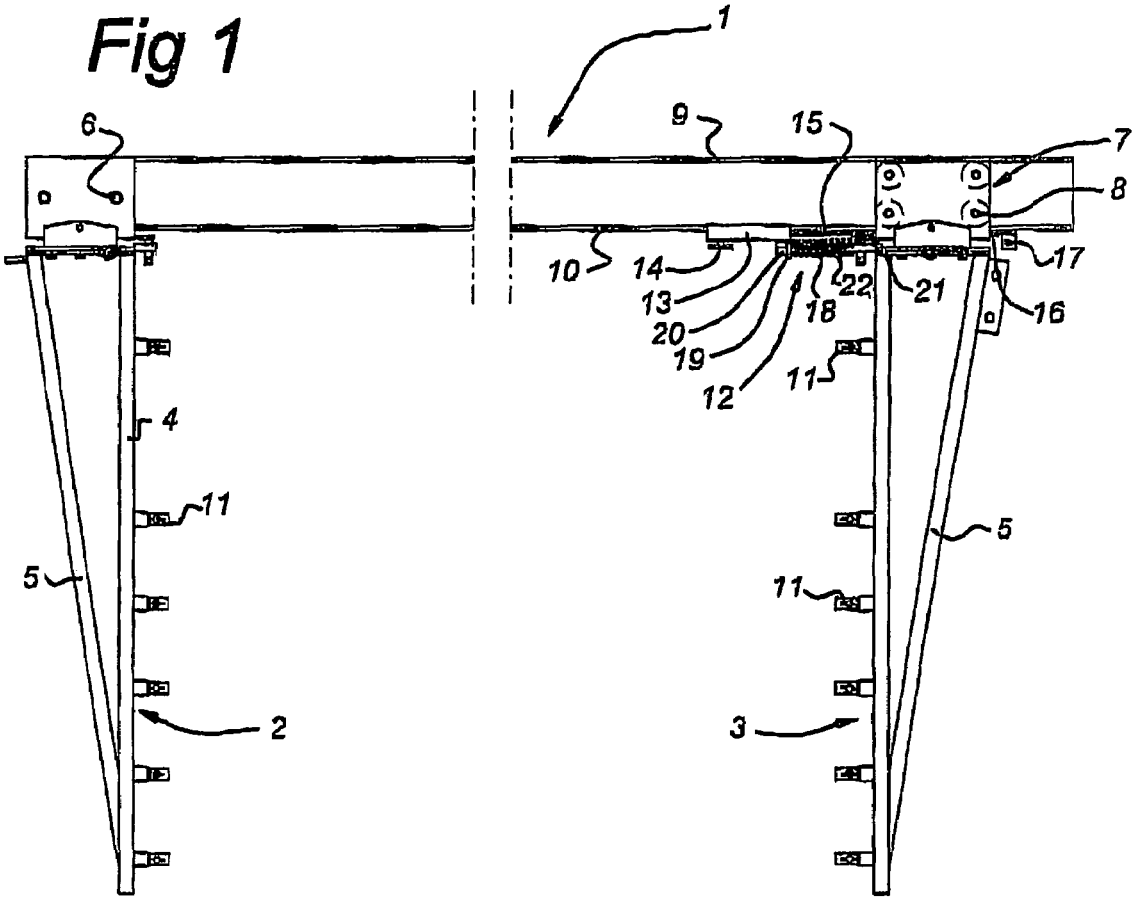
FIG. 1 shows the fame partially in side view.
Figure 2:
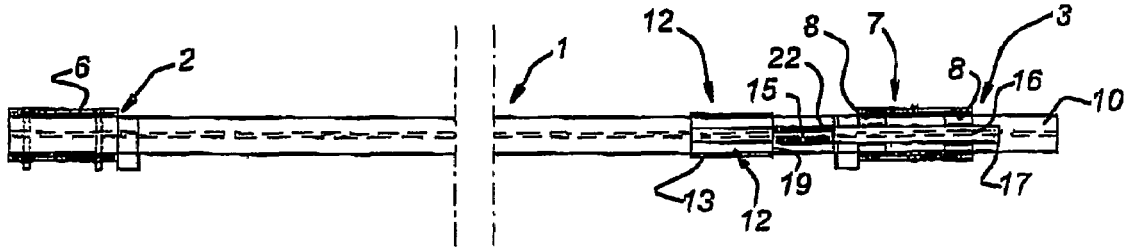
FIG. 2 shows the frame partially in plan view.
Figure 3:
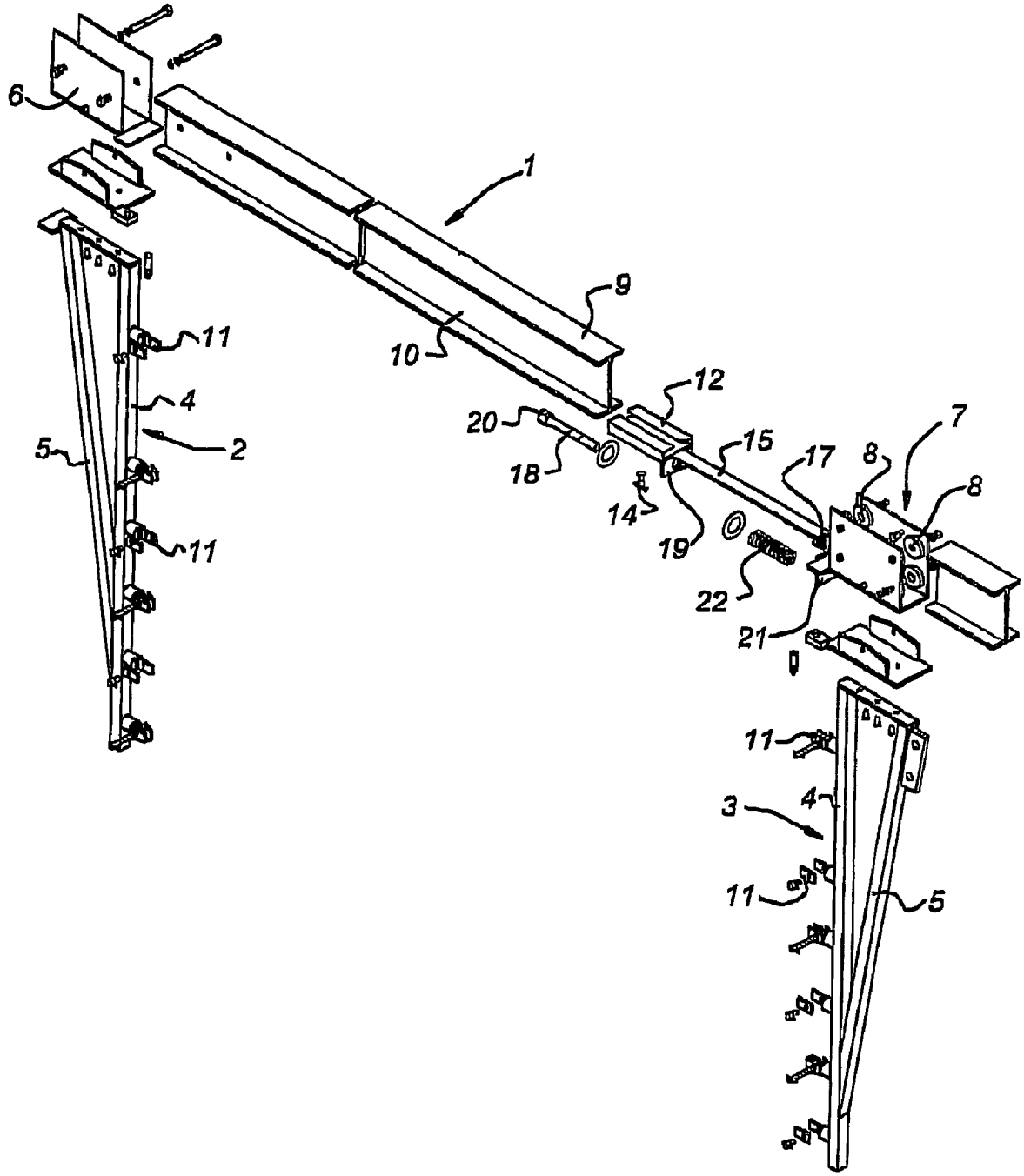
FIG. 3 shows the frame partially in the exploded state.

The frame according to the invention comprises a support 1 constructed as an I beam, with respect to which the two legs 2, 3 extend laterally parallel to one another. The legs each have a triangular shape with a mutually parallel main member 4 that is braced by the strut 5 that is somewhat inclined.

The one leg 2 is fixed by means of a bolted joint 6 to the I-shaped beam 1. The other leg 5 is supported by means of a trolley 7, which has wheels 8, such that it can be moved along the support 1. The rollers each bear on one of the flanges 9, 10 of the I-shaped support 1.

The beams 4 of the supports 2, 3 each have clamps 11, by means of which a sheet (not shown) can be clamped. The clamps 11 also have electrical contacts, so that a voltage can be applied to the taut sheet.

During the electrolytic treatment of the sheet concerned the latter becomes warmer, as a result of which expansion follows. However, it is important that the sheet remains taut under tensile pretension between the legs 2, 3 and for this purpose the compensation means indicated in their entirety by 12 are provided. These compensation means 12 comprise a clamp 13 that is fitted on the bottom flange 10 of the support 1. By means of a suitable screw connector 14 the clamp 13 can be secured in the desired position on the support 1 or can be released so that it can be moved.

A slider 15, which runs through a corresponding slot 16 in the trolley 7, is fixed to the clamp 13. At the end of the slider 15 remote from the clamp 13 there is a stop 17, such that the trolley is not able to ran off the slider 15.

In addition, a pin-shaped guide 18 is fixed to the leg 3, which guide 18 protrudes through a corresponding hole in the downward pointing lip 19 of the clamp 13. The pin 18 is provided with a head 20 which has a larger cross-section than the hole in the lip 19 and thus is not able to move though the hole.

A pretensioned helical spring 22 extends between the lip 19 and the stop 21 on the leg 3.

After the sheet has been stretched taut between the legs 2, 3, the clamp 13 is moved such that the lip 19 is free of the head 20 and the spring 22 is pressed in. In this state the clamp 13 is locked with respect to the support 1 by means of the screw connector 14. Should the sheet become warm and stretch under the influence of the treatment process, the tensile force produced by the spring 22 can still be maintained in the sheet because the leg 3 is able to move somewhat under the influence of the spring pretension. The movement path must be sufficiently long that the head 20 does not make contact with the lip 19.

The following may be mentioned as examples of metals form which the sheet material can be made: Al, Ti, Sc, Cu, Mg and Li.

The invention claimed is:

1. A frame for holding a metal sheet material taut, comprising:

a support, and exactly two legs which extend essentially parallel to one another transversely from the support, on which legs fixing means are provided for fixing, each one of the opposing edges of a piece of metal sheet material thereto so that the sheet is held taut under a tensile pretension, wherein, at least one of the legs can be moved along the support towards and away from the other leg, compensation means are provided to compensate for stretch and/or shrinkage of the piece of sheet material fixed between the legs to hold the sheet taut under a tensile pretension, and the compensation means comprise a spring member, one end of which is able to bear on a fixed point on the support and the other end of which interacts with the movable leg.

2. Frame according to claim 1, wherein the compensation means further comprise a securing member that can be secured in various positions along the support, the spring member extending between said securing member and the movable leg.

3. Frame according to claim 2, wherein the support comprises an I-shaped or upside-down T-shaped beam and the securing member comprises a movable clamp around the bottom flange of the support.

4. Frame according to claim 3, wherein the clamp has a slider with respect to which the movable leg can be slid, which slider has a stop to limit the sliding movement of the leg with respect to the clamp.

5. Frame according to claim 1, wherein the spring member has a helical spring as well as a guide extending through the helical spring, which guide is attached at one end to the clamp such that it can slide and at the opposing end is fixed to the leg.

6. Frame according to claim 5, wherein the guide has a stop that interacts with the clamp, such that the helical spring is pretensioned between the clamp and the leg if the stop is in contact with the clamp.

7. Frame according to claim 1, wherein the movable leg has a base provided with rollers that can be rolled relative to the beam.

8. Frame according to claim 1, wherein the legs have electric contacts for feeding an electric current through the sheet metal material.

9. Frame according to claim 1, wherein, the two legs each further have tensile clamps for clamping the piece of sheet material.

10. Frame according to claim 1, wherein, the two legs each further have stretching clamps for clamping the piece of sheet material.

11. Device for carrying out an electrochemical treatment on sheet metal, comprising:

a container for holding a liquid bath as well as a frame for holding metal sheet material taut, the frame comprising a support as well as exactly two legs which extend essentially parallel to one another transversely from the support, on which legs fixing means are provided for fixing, each one of opposing edges of a piece of metal sheet material thereto, characterised in that at least one of the legs can be moved along the support towards and away from the other leg to tautly hold the metal sheet between the two legs, the legs having clamps with electrical contacts to apply a voltage to the tautly held metal sheet, wherein, during an electrochemical treatment of the metal sheet the metal sheet becomes warmer, expands, and remains taut under a tensile pretension between the legs.

12. Device according to claim 11, wherein said container is embodied to contain the liquid bath with the liquid bath comprising chromic acid.

13. A frame for holding a metal sheet taut, comprising:

a beam support (1);

exactly two legs (2, 3) attached extending from the support and extending laterally parallel to each other, at least one of the two legs slidingly attached to the support to allow movement along the support, clamps attached to each of the two legs to hold a metal sheet between the two legs, wherein the clamps each comprise electrical contacts configured to apply a voltage to the held metal sheet, and a tensile pretension element attached leg to maintain the held metal sheet tautly under a tensile pretension between the two legs so that as the sheet expands the metal sheet remains taut under the tensile pretension between the legs.

14. The frame of claim 13, wherein, the support has flanges, a first of the two legs stationary and fixed to the support, and a second of the two legs is slidingly attached to the support by a trolley with wheels that are movable along the flanges of the support.

15. The frame of claim 13, wherein, the pretension element comprises a clamp fitted on a bottom flange of the support, a connector configured to releasably fix the clamp at a desired position on the support, a slider fixed to the clamp, a stop located at an end of the slider remote from the clamp, a guide fixed to the slidingly attached leg, which guide protrudes through a corresponding hole in the clamp, a pretensioned helical spring extending to the stop, wherein, the tautly held metal sheet presses the helical spring and upon expansion of the metal sheet tensile force produced by the helical spring is maintained by movement of the slidingly attached leg under the influence of the spring pretension.

16. The frame of claim 13, wherein the pretension element comprises:

a clamp releasably fixable at a desired position on the support, a slider fixed to the clamp, a guide fixed to the slidingly attached leg, which guide protrudes through a corresponding hole in the clamp, a stop located at an end of the slider remote from the clamp, a pretensioned helical spring extending to the stop, wherein, the tautly held metal sheet presses the helical spring and upon expansion of the metal sheet tensile force produced by the helical spring is maintained by movement of the slidingly attached leg under the influence of the spring pretension.

* * * * *